United States Patent [19]

Lines

[11] Patent Number: 4,967,534

[45] Date of Patent: Nov. 6, 1990

[54] WOOD I-BEAMS AND METHODS OF MAKING SAME

[75] Inventor: Jerry L. Lines, Wrightsville Beach, N.C.

[73] Assignee: MiTek Holding, Inc., St. Louis, Mo.

[21] Appl. No.: 764,180

[22] Filed: Aug. 9, 1985

[51] Int. Cl.[5] ..... E04C 3/12

[52] U.S. Cl. ..... 52/729; 52/730

[58] Field of Search ..... 52/729, 690, 730

[56] References Cited

U.S. PATENT DOCUMENTS

| | | | |
|---|---|---|---|
| 1,377,891 | 5/1921 | Knight | 52/729 |
| 1,911,413 | 5/1933 | Wait | 52/729 |
| 3,490,188 | 1/1970 | Troutner | 52/729 |
| 3,960,637 | 6/1976 | Ostrow | 52/729 |
| 4,191,000 | 3/1980 | Henderson | 52/729 |
| 4,195,462 | 4/1980 | Keller et al. | 52/729 |
| 4,336,678 | 6/1982 | Peters | 52/729 |
| 4,413,459 | 11/1983 | Lambuth | 52/729 |

FOREIGN PATENT DOCUMENTS

| | | | |
|---|---|---|---|
| 22309 | 4/1948 | Finland | 52/729 |
| 356265 | 9/1961 | Switzerland | 52/730 |
| 978639 | 12/1964 | United Kingdom | 52/729 |

*Primary Examiner*—Michael Safavi

*Attorney, Agent, or Firm*—Senniger, Powers, Leavitt and Roedel

[57] ABSTRACT

A fabricated wood I-beam is formed with a pair of elongated chord members and planar web members interconnected to the chord members by specially shaped mechanically interlocking and adhesively secured joints. Elongated chord members are provided with longitudinally extending grooves which have cross sections shaped to provide a necked-down groove width at a groove depth intermediate the open mouth of the groove and the bottom of the groove. Opposite edges of the web members are shaped to provide cross sections with a necked-down thickness along each of such web edges and configured so that the shaped web edges substantially mate with the chord member grooves to form a mechanically interlocking fit. Methods for making such wood I-beams include methods for making chord grooves of desired configuration, making correspondingly shaped web edges, and assembling the shaped web edges in the chord grooves to form a mechanically interlocking joint which is adhesively secured. Such methods of making such wood I-beams also include a preferred gluing system by which, prior to inserting shaped edges of the web members into mating chord grooves, glue is applied by positive metered feed to upwardly disposed surfaces of the web edges and the chord grooves at a rate correlated to the rate at which said chords and web members are moved in the direction of the longitudinal axis of the chords so that glue is applied to those upwardly disposed surfaces as a continuous glue line bead extending in the direction of the longitudinal axis of the chords.

23 Claims, 5 Drawing Sheets

WOOD I-BEAMS AND METHODS OF MAKING SAME

Background of the Invention

This invention relates to an improved wood beam fabricated from a pair of wood chord members and a web member interconnecting such chord members by means of glued joints, and to a method for making the same.

The rising costs of sawn lumber in general and the scarcity of high quality wood capable of producing beams of large size have led to the development of processes for fabricating large beams from less expensive and more available wood products. The use of fabricated beams also permits more efficient design requiring less wood to provide a beam of a given strength. This not only saves wood but also reduces the cost of transportation and facilitates the erection of wooden structures.

Where strength is required to support loads applied primarily in one direction, considerable saving of weight and material costs may be accomplished by using a fabricated wooden I-beam. This general design provides the required strength to support compressive and tension loads generated by application of a load to the top of the I-beam resting on supporting structure, as when such a beam is used as a rafter or joist.

When a downward load is applied to the top of an I-beam which has its ends supported from below and its "I" cross section in an upright orientation, the stresses which are generated are generally distributed as compression along the top chord or flange portion of the I-beam and tension in the bottom chord or flange portion. The width of the top and bottom chords or flanges provides the required lateral stiffness allowing the use of a narrow vertical web connecting the flanges. Thus, for a given load-supporting capacity in this type of environment, an I-beam is lighter than a solid beam having a rectangular cross section.

This invention relates to wooden I-beam structures wherein both the chord or flange members and the webs may either be solid wood members or composite or laminated wooden members as desired. Beams of this general type have been disclosed extensively in the prior art as illustrated, by way of example, in U.S. Pat. Nos. 3,490,188, 4,074,498, 4,191,000, 4,195,462, 4,249,355, 4,336,678, 4,413,459, 4,456,497 and 4,458,465, the foregoing listing being intended as exemplary only and not as all inclusive.

Prior known procedures and arrangements for forming prefabricated wood beams by gluing various members together have entailed time-consuming operations using external clamping means to hold the members together in assembled relation while the glue is setting with or without the aid of heat and/or radio frequency energy. If heat and/or radio frequency energy is used to set the glue more quickly, the cost is increased by the amount of energy thus employed.

In one prior design disclosed in Troutner U.S. Pat. No. 3,490,188, opposite margins or edges of the web members are pressed to a tapered shape and fastened by glue in a tapered groove in each flange or chord. As the web absorbs glue when it is inserted into the groove of the flange or chord, the wood swells and the web tends to resume its original shape. The compression of the margins of the web damages the wood fiber structure, and the swelling causes a residual stress in the completed I-beam tending to split the flange. The latter is of more particular significance when the flanges are formed of solid lumber.

According to a still further prior design disclosed in Eberle U.S. Pat. No. 4,456,497, joints are formed in wooden I beams by forming scarfs in the opposed edges of the web member and then inserting these scarfed edges into correspondingly shaped slots in the chords. This joint and system involves some problems in assembly of the web and the chords and gluing thereof, and some unbalance of stress in the chords or flanges.

Another type of prior joint in a fabricated wooden beam is illustrated in Keller et al, U.S. Pat. No. 3,991,535. This joint includes two relatively inclined grooves in the chord that intersect each other at a location above the surface of the chord. Flexible tongues are formed in the edge portion of the plywood web and are constructed and sized to be received in respective grooves in the plywood chord. This construction requires that the lower terminus of the glue lamina or joint between each of the plurality of layers of veneers in the plywood web be located above the surface of the chord. While this type of joint may be suitable for many structural purposes, its structure is such that when it is placed under loading, the adhesive bond between the layers of veneer forming the tongues and the adjacent intervening layer of veneer will tend to separate, weakening the joint. In general, attempts to provide suitable joints between the webs and chords or flanges of fabricated wooden I-beams through the use of multiple grooved interconnections substantially increases the cost of fabrication and reduces the cross section of the web by the internal grooving or kerfing near the interface.

According to another prior design disclosed in Talbott U.S. Pat. No. 3,477,485, wooden I-beams are manufactured by bending grooved chords or flanges to open up the grooves, relatively moving the flanges and the edges of a web together so that the opened grooves enclose the web edges, and then allowing the flanges to spring back so that the grooves close and grasp the web edges to form an assembled beam. This involves some production problems and may also result in a residual stress in the flanges of the completed I-beam tending to split the flange.

Other arrangements and types of flange-to-web joints in fabricated wood I-beams have been proposed in the prior art, and it is to be understood that the foregoing discussion is intended as illustrative and not as all inclusive. While certain of these prior known arrangements and systems may provide one or more advantages, they also present problems and disadvantages.

Summary of the Invention

It is a primary object of the present invention to provide a fabricated wooden I-beam and a method or system for fabricating the same which overcomes or at least minimizes the disadvantages encountered with prior I-beams and methods of making same, and which provides a simple, inexpensive and structurally strong design susceptible of manufacture by a relatively straightforward and efficient economical process.

One of the principal objects of the present invention is to provide an I-beam constructed from solid wood or laminated veneer lumber that is simple and inexpensive to manufacture and which is so constructed as to naturally produce a substantially mechanically locked interface between the interfitted wooden members at the flange-to-web joints when the beam is assembled and as the adhesive along the glue joints sets or cures.

It is another object of the invention to provide a wooden I-beam which utilizes a unique interlocking web-to-flange joint which permits the use of standard adhesives or glue without necessitating elaborate clamping or curing means.

It is another object of the invention to provide a wooden I-beam having a superior adhesive bond between the web and chord members wherein the groove in the chord members and the edges of the webs are scarfed or formed using available milling, routing, cutting, transporting and assembling equipment.

It is another object of the present invention to provide a joint for interconnecting a plywood web and a chord that is self-locking once the web and chord are joined, thus eliminating the need for clamping the two while awaiting completion of the cure of adhesive to permanently bond the web to the chord.

It is another object of the invention to provide a joint of the foregoing type which permits use of standard adhesive which may be cured without the use of heat and/or radio frequency energy.

It is another object of the present invention to provide a wooden I-beam having a minimum of included or residual stress in the flange-to-web joint and a reduced loss of cross section from the flange members in the fabrication of the joint.

It is still another object of the invention to provide a wooden I-beam of the foregoing type utilizing a joint having surfaces matchingly cut into the flange and web members to minimize residual stress caused by swelling of the edge of the web, thereby permitting the I-beam to absorb greater amounts of lateral loading without failure of the flange along the web-to-flange joint.

It is another object of the invention to provide a wooden I-beam of the foregoing type utilizing a joint that provides compensation for the tolerances in nominal thickness of the web member.

It is another object of the invention to provide a wooden I-beam of the foregoing type utilizing a joint having a substantial number of separate and spaced mating surfaces.

It is another object of the invention to provide a wooden I-beam which may be mass produced to have a consistently high strength.

It is another object of the invention to provide a wooden I-beam of the foregoing type wherein the edges of the web are configured in such a manner as to provide a predetermined spacing between the inner faces of the flanges and thereby provide the desired overall dimension (height) of the beam using flanges of predetermined thickness.

It is another object of the present invention to provide a method for fabricating a wooden I-beam of the type described hereinabove which method may be effectuated rapidly, efficiently and without the use of nails or clamps to hold pressure on the glue lines during the gluing operation.

It is still another object of the invention to provide a method for fabricating wooden I-beams of the foregoing type which may be applied to the manufacture of joists and trusses having a variety of structural applications and diverse design configurations.

It is another object of the invention to provide a fabricated wood I-beam using a pair of elongated wood chord members and a planar web member interconnecting the chord members by means of interlocking glued joints between such chord members and opposed edges of the web member wherein the interlocking joints comprise longitudinal grooves in the chord members receiving the opposed edges of the web member, with such grooves having cross sections shaped to provide a necked-down groove width at a groove depth intermediate the bottom of the groove and the open mouth of the groove, with the opposed edges of the web member having cross sections shaped to have a necked-down lateral thickness extending along the edge thereof so that such opposed edges of the web member have cross sections shaped to substantially mate with the cross section of the grooves to provide a self-relieved interlocking fit therewith.

It is another object of the invention to provide a structural wooden beam having a planar web member joined to an elongated chord member by a joint between an edge of the web member and a groove in one surface of the chord member wherein the groove comprises a pair of side walls, each of which include a pair of planes oppositely inclined in relation to the plane of the web member wherein said inclined planes of each said side wall intersect in an apex substantially parallel to and spaced from the said surface of the chord member, with the apexes of the side walls of the groove being substantially parallel to one another and spaced substantially equally from said surface to form the narrowest width dimension of the groove, with the edge of the web member being shaped to mate with said groove to form an interlocking joint.

It is another object of the invention to provide a method of making a unitary wooden beam from an elongated wooden chord member and a planar wooden web member by cutting in one surface of the chord member, substantially parallel to the longitudinal axis thereof, a longitudinal groove having a cross section with a necked-down width intermediate the depth of the groove, shaping the edge of the web member to provide a decreased thickness thereof along a portion of said edge, and inserting such edge of the web member into the groove past the necked-down portion of the groove to create a substantially mating interconnection between the edge of the web member and the groove in the chord member to form a joint therebetween.

It is still another object of the invention to provide an improved method of applying glue to certain surface(s) of opposite edges of the web members and also to certain surface(s) of the groove of the chord members to obtain and assure satisfactorily glued interlocking joints between the web members and chord members. It is a related object to provide such an improved web and chord gluing method which utilizes controllable positive metered feed of glue to said surfaces of web edges and chord grooves.

According to the invention, a unitary wooden I-beam is formed by feeding a pair of elongated flange or chord members along their axes in spaced, generally parallel relationship. The chord members have opposed grooves cut into their inner and facing surfaces. Simultaneous to this feed of the grooved flanges, a rectangular planar web member is fed between the flange members, with its longitudinal axis parallel to the axes of the chord members and with its outer edges adjacent the grooves. The top edges of the web members are coated with glue as the web moves, and the top of the bottom surface of the groove in each of the flange members is coated with glue as the flanges move; thus, both beads of glue are applied to said top surfaces of web edge and flange grooves requiring glue, thereby allowing the use of a much simplified application apparatus and visual inspection and/or instrument sensing means to assure that the glue is applied in a continuous unbroken ribbon. The flange members are gradually moved toward one another so that the glue-coated edges of the web member enter the grooves in the flange members. According to the invention, the joints between the edges of the web member and the flange members provide a unique mechanically interlocking relationship which holds the assembled members together and permits the use of standard glues or adhesives to secure the flange and web members into unitary relationship. The grooves in the flanges have cross sections which are shaped to provide a necked-down groove width at a groove depth intermediate the bottom of the groove and its open mouth. The opposed edges of the web member have cross sections shaped to have necked-down lateral thicknesses extending along the edges thereof so that the opposed edges of the web member substantially mate with the cross sections of the grooves to provide a self-relieving interlocking fit therewith.

Brief Description of the Drawings

Additional objects and advantages of the present invention will be apparent from the following detailed description and the accompanying drawings wherein.

Description of Preferred Embodiments

Figures 1, 2:
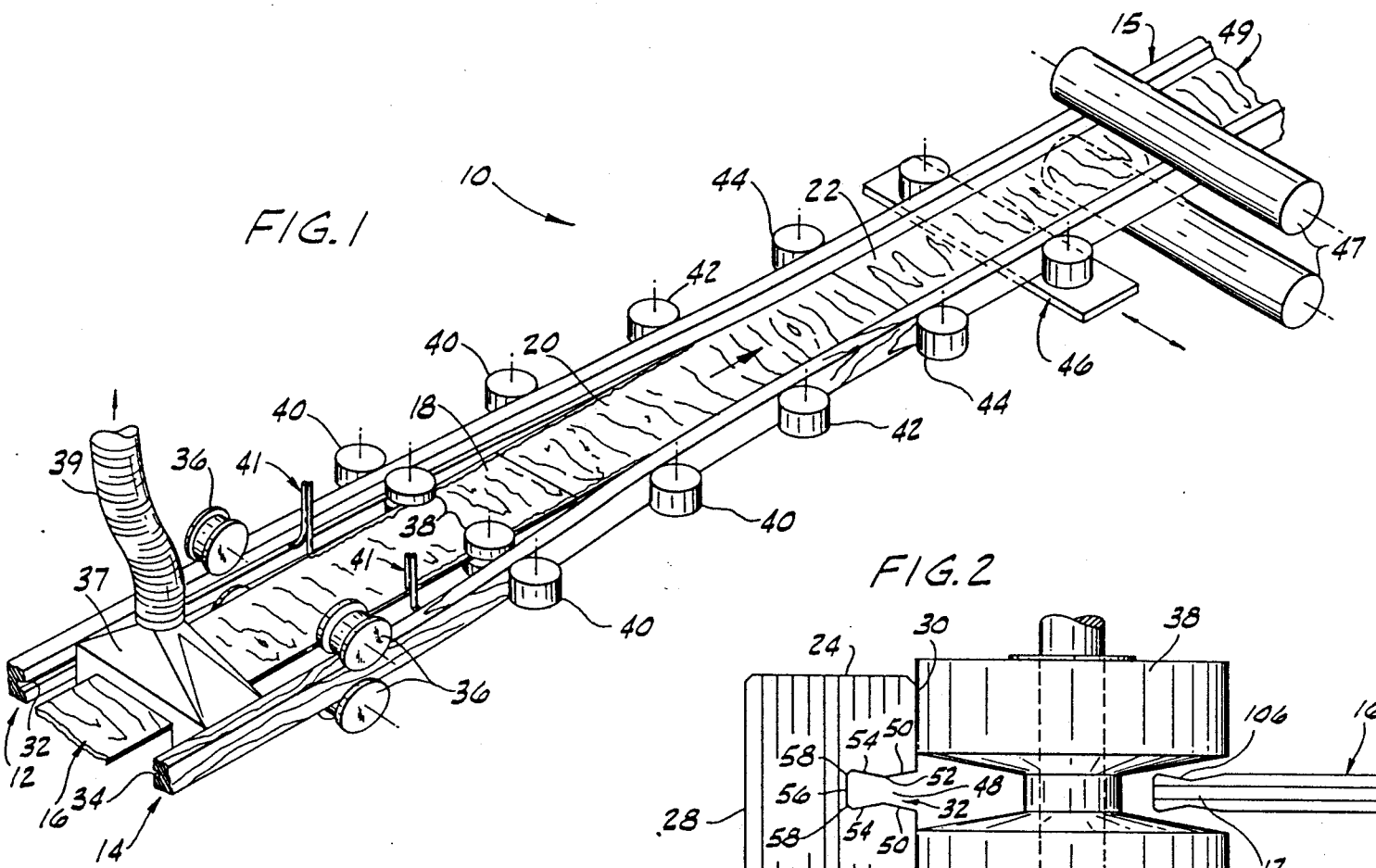
FIG. 1 is a diagrammatic perspective view showing an illustrative assembly line arrangement for performing the principal steps of joining the flanges or chords to the web of a wood I-beam constructed according to an embodiment of the invention.
FIG. 2 is a diagrammatic elevation view, partially in section, showing details of the pre-joinder disposition of an edge of the web to an adjacent grooved flange.

Referring in detail to the figures of the drawings, there is shown diagrammatically in FIG. 1 an assembly line 10 for making wooden I-beams having wood flanges or chords and wood web members. Specifically the assembly line 10 performs several operations to secure flange or chord members 12 and 14 to a wood web member 16 to form web-to-flange joints generally indicated by numeral 13. (See FIGS. 6 and 13.) The web or web member 16 is preferably formed of plywood or oriented strand board, called "OSB" (a form of flake board wherein strands of wood are oriented, overlapped and secured together by suitable glues to achieve the strength properties of plywood) or the like. The web members may be of varying thicknesses such as $\frac{3}{8}$, 7/16, $\frac{1}{2}$, $\frac{5}{8}$ inches and the like. The web member in the assembled wood I-beam constitutes a plurality of abutted sheets of such boards as illustrated in FIG. 1 at 18, 20 and 22. The sheets generally constitute rectangles which have a long dimension along a longitudinal axis which is substantially parallel to the longitudinal axes of the elongated chord or flange members 12 and 14. The web sheets form butt joints with one another, and the web members preferably are secured together at such butt joints with adhesive or glue which is applied in any known or other suitable fashion.

Figure 5:
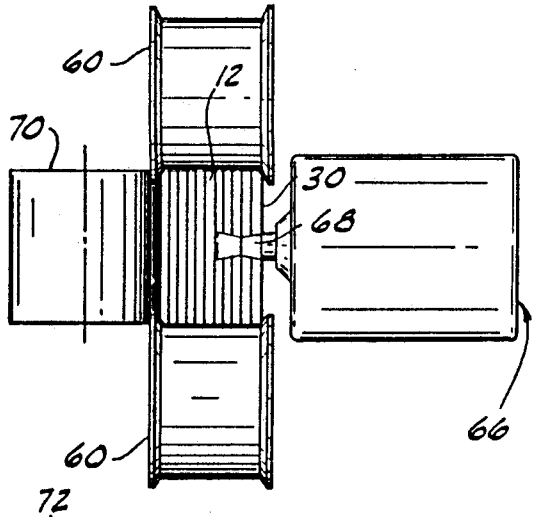
FIG. 5 is a vertical elevation view, partly in section, showing details of the second router used in FIG. 3 to make the second groove cut in the flange or chord.
Figure 4:
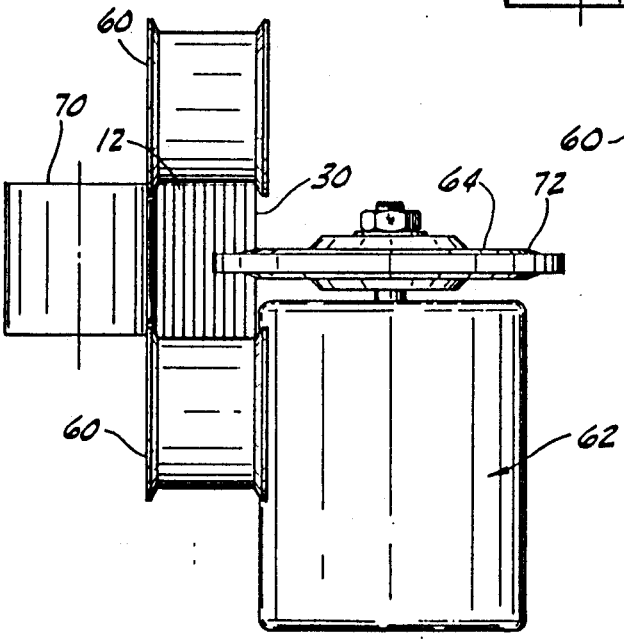
FIG 4 is a vertical elevation view, partly in section, showing details of the first cutter or router of FIG. 3 used to make the first groove cut in the flange or chord.

Each of the wood flange or chord members 12 and 14 has a generally rectangular cross section perpendicular to its longitudinal axis as may be seen in FIGS. 2, 4 and 5. The flange members may be formed of commercially available wooden structural boards such as 2×2's, 2×3's, 2×4's or the like in which all of the wooden fibers of the boards are generally parallel with the length or longitudinal axis of the boards. Alternatively, and in a preferred embodiment, the flange members may be formed of laminated veneer lumber (called "LVL") which is readily available in a large variety of lengths and thicknesses such as, for example, 1½×1½, 1½×1¾, 1½×2 5/16, 1½×2½, 1¾×2½, 1½×3½, 1¾×2 5/16, 1¾×3½ inches or the like. Such a variety of flange cross-sectional sizes is diagrammatically illustrated in FIG. 6, by way of example.

Figure 14:
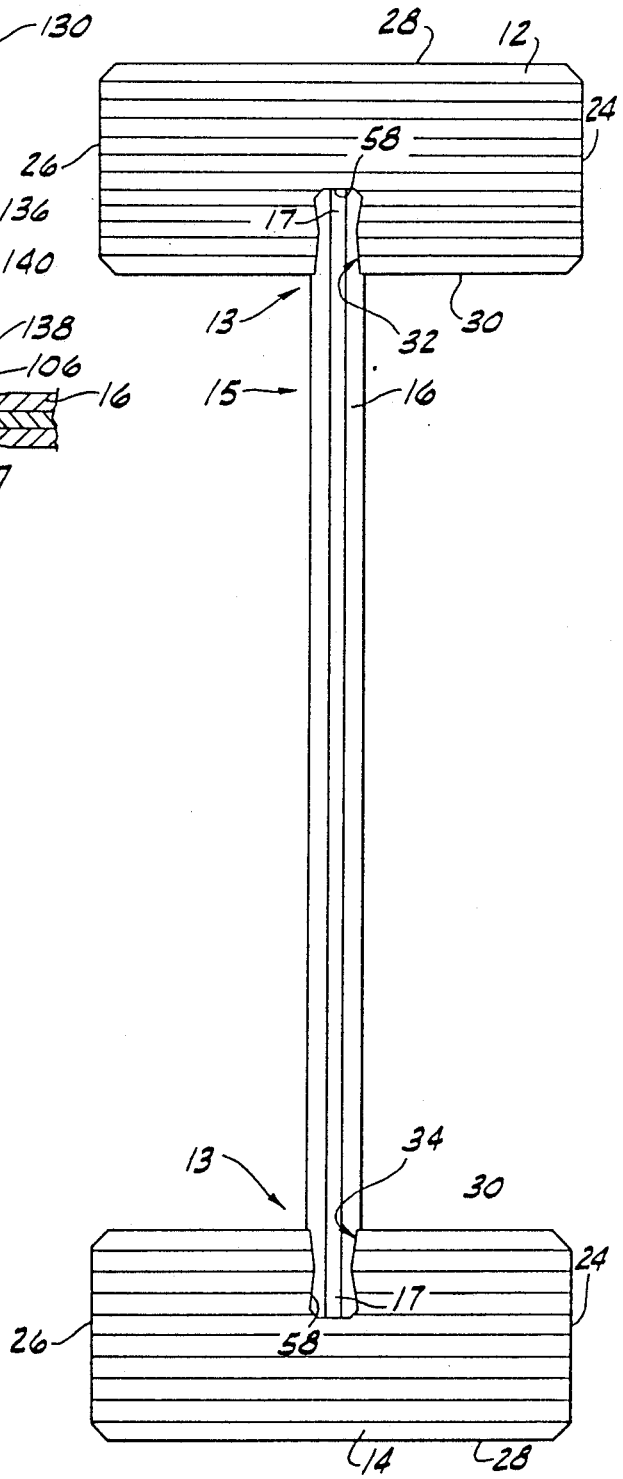
FIG. 14 is a vertical sectional view of a wood I-beam made according to the present invention, and particularly according to FIGS. 1–12 an thereof below.

Referring to FIG. 2, each of the flange members has top and bottom sides 24 and 26 and an outer face 28 and an inner face 30. The laminations in the LVL lumber extend along the longitudinal axis of the chord member parallel to the outer and inner faces 28 and 30. Referring to FIG. 14, when the I-beam is in the installed position, the web members are vertical and the chord faces 28 and 30 are horizontal, whereby the laminations above the neutral plane of the chord are stressed in compression and the laminations below the neutral plane are stressed in tension.

As seen in the assembly operation illustrated in FIG. 1, the flange members 12 and 14 have grooves 32 and 34 cut in the inner faces thereof facing one another and facing the edges of the planar web members 16. The flange members 12 and 14 are fed from left to right between guide wheels 36 which are provided in pairs rotating on horizontal axes. A dust collection hood 37 and exhaust duct 39 may be provided to clear the web edges and grooves of sawdust or other foreign particles.

The web members 16 are fed between a pair of hold-back wheels 38 rotating on vertical axes. The hold-back wheels 38 serve to hold back the flange members 12 and 14 against the action of cooperating squeeze guide wheels 40 which force the flange members 12 and 14 inwardly towards the web members.

The initial pairs of squeeze guide rollers 40 are followed by additional pairs of rollers 42 and 44 which progressively force the flanges 12 and 14 towards the web members so that the edges of the web members enter into their final disposition in the grooves 32 and 34 in the flange members 12 and 14 as will be explained in detail hereafter. It will be appreciated that the squeeze rollers 40–46 may be individually adjustable to provide the necessary force and direction to guide and move the flange members in the desired direction. A generally similar arrangement for feeding flanges into engagement with webs is described in detail in U.S. Pat. No. 3,477,485. It will be appreciated that apparatus and machinery for effecting this general type of assembly operation is known in the trade, as illustrated by way of example in U.S. Pat. Nos. 3,616,091, 3,894,908, 4,123,315 and 4,356,045.

Following the squeeze rollers, there may be provided a decamber assembly indicated generally at 46. The assembled unitary I-beam exits at 49.

As previously stated, the flanges arrive at the assembly operation depicted in FIG. 1 with the grooves already cut therein. The cutting operation may be carried out on a continuous basis in any suitable manner, such as in the manner shown by way of example in FIGS. 3, 4 and 5.

It is a feature of the present invention that the grooves utilized, to form the joint 13 between the webs and the flanges have cross-sectional shapes which provide a necked-down or narrower groove width intermediate the bottom of the groove and its open mouth as may be seen in FIG. 2 to which reference is now made. (FIG. 2 shows groove 32 of flange 12 in FIG. 1; for convenience, corresponding groove 34 of flange 14 in FIG. 1 is not shown in FIG. 2.) Referring to FIG. 2, the groove 32 in flange 12 has an open mouth 48 from which the outer inclined side walls 50 of the groove converge inwardly to a necked-down groove portion 52. The inner inclined groove walls 54 then diverge outwardly and are connected to the bottom 56 of groove 32 by chamfered or beveled edges 58. Thus it may be seen that the groove 32 comprises a pair of side walls, each of which include a pair of planes 50 and 54 oppositely inclined in relation to the plane of the web member 16. The inclined planes 50 and 54 intersect in an apex 52 which is substantially parallel to and spaced from the inner face 30 of the chord member 24. The groove 34 of opposite chord or flange member 14 will be likewise configured as groove 23 of flange member 12 but will be a mirror image thereof; see FIG. 13. Grooves 32 and 34 have a cross-sectional configuration which is "hourglass shaped" or "corset shaped".

Figure 3:
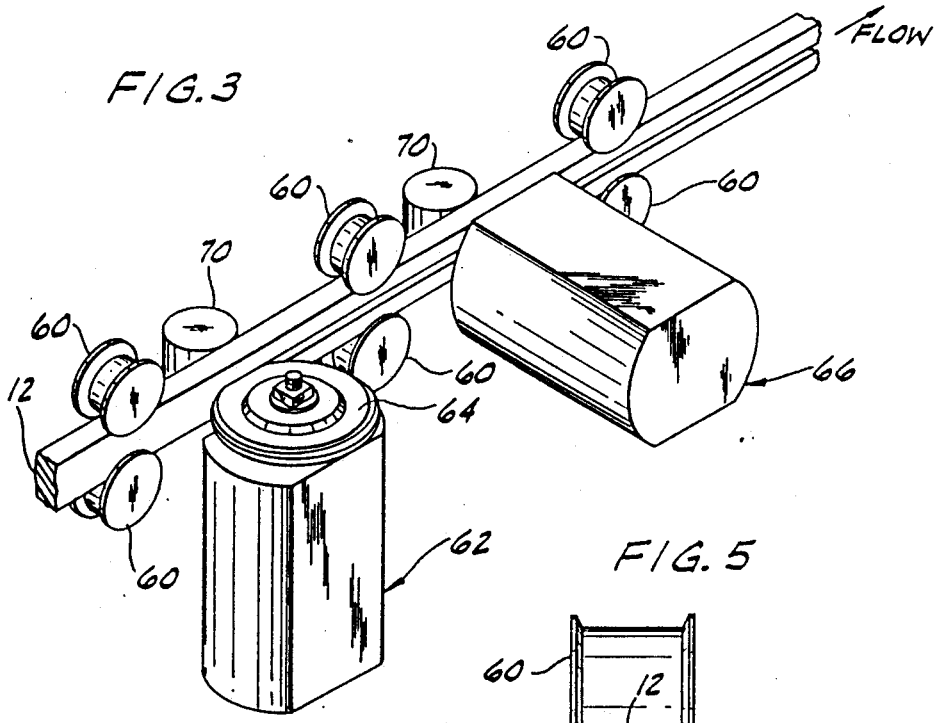
FIG. 3 is a diagrammatic perspective view of one embodiment of an arrangement for cutting the groove into one of the chord members to be fed into the assembly line of FIG. 1.

Referring to FIGS. 3, 4 and 5, there is shown an arrangement for forming this type of flange groove described with reference to FIG. 2. Referring particularly to FIG. 3, the flange member 12 is fed from left to right between flanged guide and feed rollers 60 rotating on horizontal axes. A first vertical axis router 62 is provided with a dado cutter blade 64, best seen in FIG. 4. It will be understood that the dado cutter blade 64, shown diagrammatically in FIGS. 3 and 4, may be supplied with suitable teeth or cutting edges in a conventional manner.

A second horizontal axis router 66 is provided with a conventional router bit 68 which may be best seen in FIG. 5. It will be understood that the router bit shown diagrammatically in FIG. 5 may be supplied with suitable cutting edges in a conventional manner. Guide wheels 70 rotating on vertical axes hold the flange 12 against the cutting tools as may be seen in each of FIGS. 3, 4 and 5.

Referring to FIG. 4, the dado cutter blade 64 on the first cutter 62 may be of such a diameter, and the router may be so disposed relative to the chord member 12, as to cut the groove to the desired depth. The width of the blade 64 at its outer periphery is dimensioned to cut the inner section of the groove to the width desired for the necked-down groove portion 52 or to a width which is no greater than this dimension. The blade 64 is also provided with a tapered portion 72 seen in FIG. 4 which is shaped to cut the inwardly tapered side walls 50 extending to the open mouth 48 of the groove as illustrated in FIG. 2.

The horizontal axis of second cutter 66 has a router bit 68, wherein the vertical cross section of the bit in FIG. 5 is substantially the same as the cross section of the groove 32 in the flange 12 as illustrated in FIG. 2 and described above. Thus, according to the arrangement shown in FIGS. 3, 4 and 5, the second router 66 cuts the outwardly diverging walls 54 at the bottom of the groove as well as the bevels 58. While the entire groove could be cut by the router bit 68, it has been found that the use of the two-cutter arrangement of FIGS. 3, 4 and 5 permits faster flange feed with less wear on the cutting tools.

In a production line system, a second set of oppositely disposed cutters like first cutter 62 and second cutter 66 would be used in like manner to form a like groove 34 in the second flange member 14. For examples of general arrangement of suitable systems for such purpose, see above-mentioned U.S. Pat. Nos. 3,477,485, 3,616,091, 3,894,908 and 4,356,045.

Other arrangements for cutting grooves of the desired shape may be utilized according to the disclosure herein, as further discussed below with reference to FIGS. 15–17.

Figure 9:
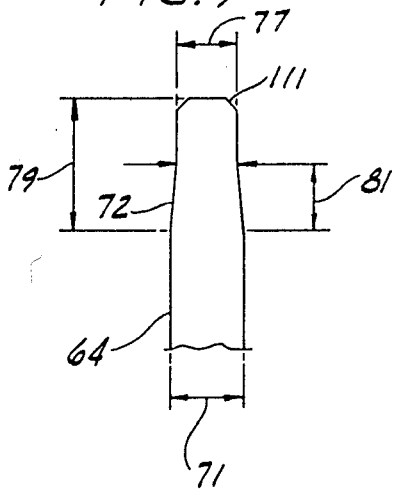
FIG. 9 is a partial cross-sectional view of the cutting edge of a dado cutter blade configured to make the first cut in the flange to form the groove as shown in FIG. 3.
Figure 10:
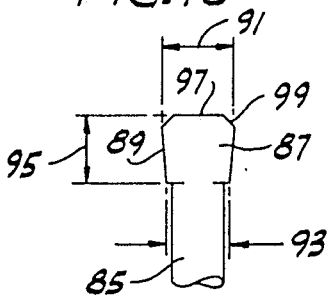
FIG. 10 is a partial cross-sectional view of a router bit shaped to make the second cut in the flange to form the groove as shown in FIG. 3.

Referring to FIGS. 9 and 10, the shapes of the cutting tools 64 and 68 of FIGS. 3 and 4 are illustrated in further detail. Referring in particular to FIG. 9, the dado cutter blade 64 in FIG. 3 has an inner circular section having a thickness or width 71 which is equal to the desired width of the mouth of the groove illustrated at 73 in FIG. 7. The outer periphery of the cutter blade 64 is of a thickness 77, which is the same as or preferably slightly less than the necked-down width dimension 52 of the groove 32 shown in FIGS. 2 and 7. The radius of the dado cutter blade 64 and the position of its axis of rotation relative to the flange 12 in FIGS. 3 and 4 is such as to cut the groove to the desired depth indicated at 75 in FIG. 7. The radial dimension of the cutter blade 64 between its outer edge and the inner periphery or diameter of the tapered portion 72 is shown at 79 in FIG. 9 and is equal to the groove depth shown at 75 in FIG. 7. The outer periphery of the dado cutter blade 64 is provided with edges 111 which are chamfered at 45°. The depth of the groove from its open mouth at the plane of the inner surface 30 of the flange 12 to the necked-down portion 52 is indicated at 83 in FIG. 7. The corresponding dimension on the dado cutter blade 64 is indicated at 81 in FIG. 9.

Referring to FIG. 10, the router bit 68 as seen in FIG. 5 has a shaft 85 carrying a cutter head 87. The cutter head 87 comprises an enlarging conical surface 89 having an outer diameter indicated at 91 and an inner or smaller diameter indicated at 93. The axial length of the head between these diameters is indicated at 95. The cutter terminates in a flat end 97 having a 45° beveled or chamfered edge 99 which cuts a 45° chamfered edge 58 at the bottom of the groove 32. In an illustrative example, for a ⅜-inch nominal thickness web 16, edges 58 would be 1/16 inch.

Figure 12:
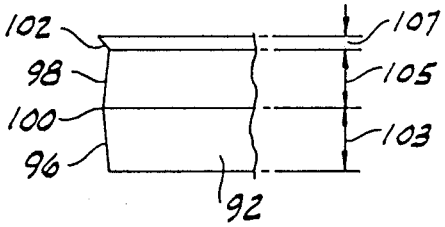
FIG. 12 is a partial cross-sectional view of the cutting edge of one of the scarfer cutting blades shown in FIG. 12, shaped to cut one surface of the edge of the web seen in FIGS. 8 and 12.
Figure 11:
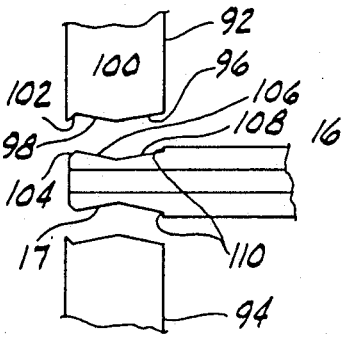
FIG. 11 is a partial cross-sectional view showing a pair of scarfer blades (of a type shown in FIG. 12) disposed in spaced relation to the edge of a web member prior to engagement with the edge to simultaneously cut both the upper and lower surfaces of the edge of the web in FIGS. 8 and 2.

According to the invention, the edges of the web members 16 which are adapted to enter the grooves 32 and 34 of flanges 12 and 14 are shaped as indicated at 17 to provide an interfitting joint; see FIGS. 2, 6–8 and 13. Shaped web edges 17 of web members 16 have a cross-sectional configuration which is "hourglass shaped" or "corset shaped" similar to the cross section of grooves 32 and 34 of the chord members 12 and 14 to form a joint therewith. One arrangement for cutting the web member edges to the desired shape is illustrated in FIGS. 11–12. Referring now to FIG. 11, a web member 16 may be moved along its longitudinal axis in relative motion past a pair of scarfer cutters 92 and 94 which rotate on horizontal axes as shown in FIG. 11. The cutters 92 and 94 are illustrated in FIG. 11 in a retracted position removed from their cutting position against the edges of the web member 16 in order to illustrate the facets of the scarfer cutting tools and the shape imparted to the web member. Thus the upper tool 92 is provided with canted scarfer cutting surfaces 96 and 98 which meet in the apex 100 of a shallow "V". The leftmost edge of the cutting tool 92, as seen in FIG. 11, terminates in a lip 102 shaped to cut the beveled or chamfered edge 104 of the web 16. It will be appreciated that the lower blade 94 is shaped and disposed to cut a mirror-image surface on the lower edge of the web member 16 as seen in FIG. 11. The axes of rotation of the scarfer blades 92 and 94 in the ultimate cutting position is such as to form seating edges 110 on the web 16. The canted or inclined surfaces 96 and 98 of the blade 92 cut the downwardly sloped faces 106 and 108 on the upper edge of the web member 16. Corresponding surfaces of lower mirror image scarfing blade 94 cuts corresponding mirror image surfaces on the lower edge of web member 16, as will be apparent from FIG. 11 and other disclosure herein. The scarfer blade is shown in further detail in FIG. 12. Referring to that figure, the axial dimension of the first inclined scarfer cutting surface 96 is indicated at 103; the axial dimension of second inclined scarfer cutting surface 98 is indicated at 105; and the axial dimension of the bevel or chamfer 102 is indicated at 107.

Figure 8:
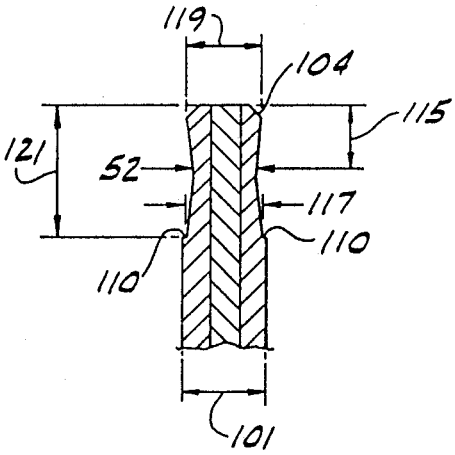
FIG. 8 is a partial cross-sectional view showing details of the edge of the web member configured for joining with the flange of FIG. 7.

The cutting of shaped edges 17 of the web member 16 to provide the seating edges 110 according to the invention serves several advantageous purposes. The width of the shaped edge portion 17 of the edge of web 16 shown at 117 and 119 in FIG. 8 is predetermined at a value which allows for normal tolerances in the thickness of the web 16 and prevents undersized webs from destroying or derogating the interlock feature of each joint between web 16 and flanges 12 and 14. Thus these dimensions 117 and 119 are less than the expected minimum tolerance thickness for the particular thickness of web 16 being utilized. The spacing between the seating edges 110 on opposide sides of shaped edge portions 17 of the web 16 is predetermined in the manufacturing process. The predetermined spacing 117 between corresponding seating edges on opposed shaped edges 17 of the web 16 provides an engineered depth of shaped edges 17 independent of the depth of insertion of the edges 17 of the web 16 into the flange grooves. At the same time, the depth of the web edge 17 which penetrates the groove is also predetermined. Still further, the use of the web seating edges adds additional mating surfaces to be adhesively secured in the joints. Thus referring to the drawings, especially FIGS. 2, 6 and 8, it will be seen that the joint formed according to the invention has seven to nine different mating surfaces. These are the bottom 56, the two inclined groove walls 54, the two inclined groove walls 50 and the two seating edges 110, plus the two beveled or chamfered edges 58.

According to the invention, the width 73 of the flange groove at its open mouth 48 is a dimension which is preferably slightly smaller than the minimum thickness of the web member 16 which would be expected within normal commercial tolerance variations from the nominal web thickness indicated at 101 in FIG. 8. This insures that the mechanical interlock in the web-to-flange joint 13 of this invention will not be destroyed or diminished by any tolerance variation from nominal dimensions which may be reasonably expected. This configuration and dimensioning provides the seat or edge 110 on the shaped edges 17 of the web 16, which also provides an additional bonding surface between the flange and the web to even further insure a strong glue joint as described hereinbefore.

Figure 6:
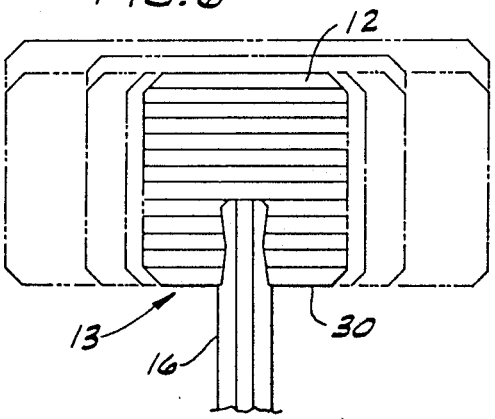
FIG. 6 is a partial cross-sectional view showing a web and flange assembled according to the invention and showing in phantom a depiction of various sizes of flanges which may be utilized with the joint.
Figure 7:
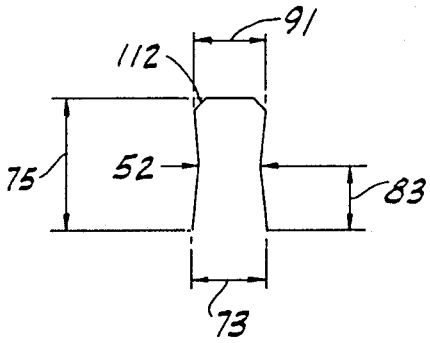
FIG. 7 is a partial cross-sectional view showing details of the groove cut into the flange and dimensional aspects thereof according to one embodiment of the invention.

Referring to FIGS. 7 and 8 on the one hand and FIG. 6 on the other hand, the flange 12 (or 14) and web member 16 are respectively shown in FIGS. 7 and 8 in an unjoined disposition and in FIG. 6 in a joined disposition.

The groove 32 of flange 12 illustrated in FIGS. 6 and 7 (and corresponding groove 34 of flange 14) is of the type formed using the method and apparatus of cutting described in connection with FIGS. 3–5. FIG. 6 diagrammatically illustrates in phantom the various sizes of flanges which may be utilized according to the invention. It will be appreciated that still different dimensioned flanges and webs may be used if desired. The edge of the web member 16 in FIGS. 6 and 8 is prepared using the method and apparatus of cutting described with reference to FIGS. 11 and 12.

In a production line system, a first and second set of scarfer blades shown in FIGS. 11–12 would be arranged to cut opposite edges of web 16 as above-discussed and preferably simultaneously. An example of a suitable arrangement usable for such purpose is shown in U.S. Pat. No. 4,356,045.

The joint 13 of this invention is a balanced joint in the sense that it includes the oppositely inclined planes to provide balanced reaction to the loading normally encountered by wooden I-beams. When a downward load is applied to the top of an I-beam which has its ends supported from below and the "I" cross section in an upright orientation as in FIG. 14, the stresses which are generated are generally distributed as compression along the top chord or flange portion of the I-beam and tension in the bottom chord or flange portion. As a result, the stresses in the joints differ because of the different stresses in the chords. The balanced joints 13 of the I-beam 15 made according to the present inventions respond advantageously to such loading conditions.

Following are illustrative dimensions for the cutting tools, flange grooves and web edges for a preferred embodiment of I-beam according to the present invention using a web member having a nominal thickness of ⅜ inch.

| Dimension Indicated | Reference Numeral | Dimension Inches |
|---|---|---|
| Nominal web thickness | 101 | 0.375 |
| Width of groove mouth | 73 | 0.345 |
| Width of necked-down groove section | 52 | 0.285 |
| Width of groove bottom (before chamfer) | 91 | 0.345 |
| Overall groove depth | 75 | 0.625 |
| Groove depth from mouth to neck | 83 | 0.312 |
| Overall width of shaped web edge | 117 | 0.345 |
| Overall length of shaped web edge | 121 | 0.625 |
| Dimension of shaped web edge from distal edge to necked-down portion | 115 | 0.312 |
| Angle of groove chamfer | 112 | 45° |
| Length of groove chamfer | 112 | 1/16 |
| Axial length of chamfer | 107 | 0.063 |
| Width of each seating edge of web for nominal .375 web thickness | 110 | 0.015 |
| Axial length of inclined scarfer edge surface adjacent chamfer | 105 | 0.25 |
| Axial length of inclined scarfer edge surface spaced from chamfer | 103 | 0.312 |
| Width of dado cutter at outer periphery | 77 | 0.280 |
| Width of dado cutter at inner periphery (groove mouth) | 71 | 0.345 |
| Radial dimension of dado cutter between necked-down portion and inner periphery | 81 | 0.312 |
| Radial dimension of dado cutter from outer to inner periphery | 79 | 0.625 |

Figure 15:
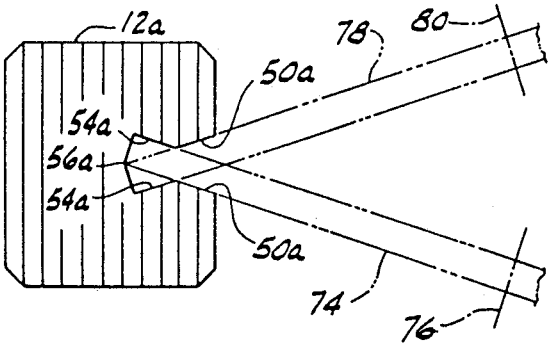
FIG. 15 is a partial cross-sectional view of another embodiment of an arrangement for cutting the grooves in the flanges or chords to, be fed into the assembly line illustrated in FIG. 1.
Figure 17:
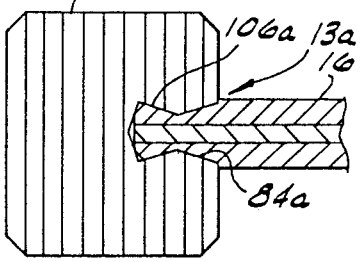
FIG. 17 is a partial cross-sectional view showing the web and flange of FIG. 16 in assembled relationship.
Figure 16:
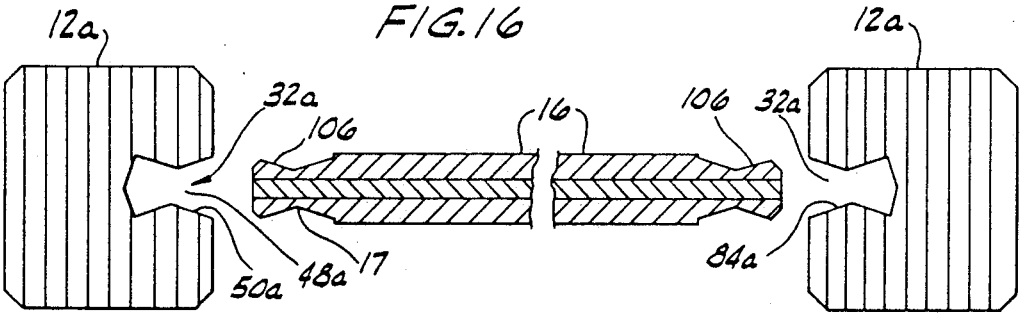
FIG. 16 is a partial cross-sectional view showing a pair of flanges or chords having a groove cut in the manner illustrated in FIG. 15 and disposed adjacent a web for interlocking assembly therewith.

Reference is now made to FIGS. 15–17 showing a second embodiment. Components of the embodiment of FIGS. 15–17 which are like those of the embodiment of FIGS. 1–12 are identified with like numerals; and analogous components are identified with like numerals and the letter a. FIGS. 16 and 17 illustrate a joint generally indicated at 13*a* formed according to such second embodiment of the invention. The groove 32*a* in the flange 12*a* is formed in a manner now described with reference to FIG. 15. Using the groove-cutting system illustrated diagrammatically in FIG. 15, a flange member 12*a* (like flange member 16 of FIGS. 1–12 in pre-cut condition) is fed sequentially past a first cutter (saw) blade, shown in broken section at 74, rotating on a canted axis 76 and then past a second cutter (saw) blade 78 rotating on an oppositely canted axis 80. The blades 74 and 78 cut the converging inwardly inclined outer groove walls 50 as well as the diverging outwardly inclined inner groove walls 54*a* in flange member 12*a*. The edge of the web 16 is formed in the same manner as described with reference to FIGS. 11 and 12. The assembled joint 13*a* according to this embodiment of the invention is shown in FIG. 17.

The assembled I-beam according to this embodiment made according to FIGS. 15–17 is like the I-beam made according to FIGS. 1–12 and shown in FIG. 14. Dimensional relationships for the flange grooves 32*a* and edges of web 16 for joint 13*a* made according to FIGS. 15–17 will be the same, or substantially the same, as for corresponding components of joint 13 made according to FIGS. 1–12 as discussed above.

Figure 18:
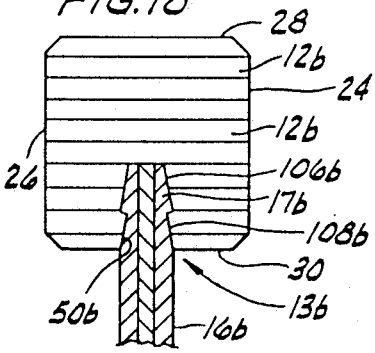
FIG. 18 is a partial cross section showing another embodiment of interlocking joint between a web and chord flange to form an I-beam according to the present invention.
Figure 19:
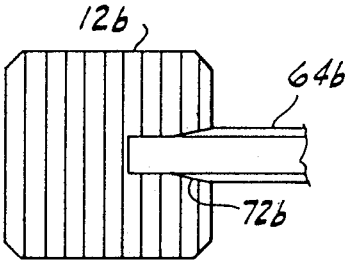
FIG. 19 is a partial cross-sectional and elevation view (similar to FIG. 4) showing the first cutter means for making the first groove cut in the chord flange to make the joint shown in FIG. 18.
Figure 20:
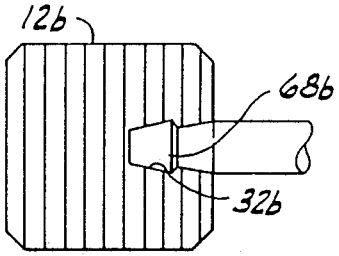
FIG. 20 is a partial cross-sectional and elevation view (similar to FIG. 5) showing the second router means for making the second groove cut in the chord flange to make the joint shown in FIG. 18.

Referring now to FIGS. 18–20, there is illustrated at 13*b* another web-to-flange joint formed according to a third embodiment of the invention. Components of the embodiment of FIGS. 18–20 which are like those of the embodiment of FIGS. 1–12 are identified with like numerals; and analogous components are identified with like numerals and the letter b. The groove 32*b* in each chord flange 12*b* (same as flange 12 precut) is formed by: making a first cut using a dado cutter cutter blade 64*b* as illustrated in FIG. 19 (in a manner similar to that of FIG. 4 described above with respect to the embodiment of FIGS. 1–12); and making a second cut using a router bit 68*b* as illustrated in FIG. 20 (in a manner similar to that of FIG. 5 described above with reference to the embodiment of FIGS. 1–12). The edge 106*b*, 108*b* of web 16*b* is formed with end configuration corresponding to flange groove 32*b* as shown in FIG. 18 in a manner similar to that described with reference to FIGS. 11 and 12. The assembled joint according to this embodiment of the invention is shown in FIG. 18; and the assembled I-beam according to this embodiment is like the I-beam 15 shown in FIG. 14 but having a modified web-to-chord joint such as shown at 13*b* in FIG. 18. Dimensional relationships for the flange grooves 32*b* and edges of web 16*b* for joint 13*b* made according to FIGS. 18–20 will be substantially the same as for corresponding components of joint 13 made according to FIGS. 1–12 as discussed above.

Referring to FIGS. 1 plus 2, 6–8 and 11, the method of I-beam assembly is further described. The flanges 12 and 14 are laterally moved relatively toward one another and the edges of web member 16 until the outer edge of the web member enters the mouth 48 of the flange groove. The chamfer 104 on opposite edges of the web 16 facilitates the entry of the web edge into the groove mouth 48. As the web and flanges move relatively toward one another beyond the entrance of the web member edge into the groove mouth 48, the maximum width portion 119 of the web edge is compressed by the converging inner faces 50 of the groove 48 until the maximum edge width portion 119 of the web member passes the necked-down portion 52 of the flange groove 32. As the relative insertion of the web member into the grooves of the flanges continues, there is a self-relieved "return-action" wherein the maximum width edge portion 119 of the web member 16 expands to resume substantially its original shape, whereby the web edge 104, 106, 108 moves into a mating and interlocking position in the groove 32 as shown in FIG. 6. This arrangement provides a mechanical interlock holding the web member 16 and flanges 12, 14 together without the aid of clamps or other fixtures. See also more detailed discussion below of the relationship between components of shaped ends 17 of web 16 and openings 48 of grooves 32 and 34 to produce such mechanical interlocking between web member 16 and flanges 12, 14. This mechanical interlock of web and flanges facilitates the use of standard adhesives or glue and avoids the need for rapid curing glue or special curing equipment; this expedites production techniques and rate of production while minimizing cost.

Referring to FIG. 1 plus FIG. 2, it will be seen how the flanges 12 and 14 are gradually moved into engagement with the web members 16 so that such mechanical interlocking of the web edges and flange grooves occurs as above-described. Before such mechanical interlocking of the web edges and flanges, glue or adhesive is applied by suitable glue application means to the surface 50 of the groove opening 48 in each of flange members 12 and 14 and to the surface 106 at each of the opposite edges of web members 16. Suitable adhesives such as phenol resorcinol/formaldehyde ("PRF") or preferably fast curing adhesives such as emulsion polymer isocyanate ("EPI") may be utilized.

Figure 13:
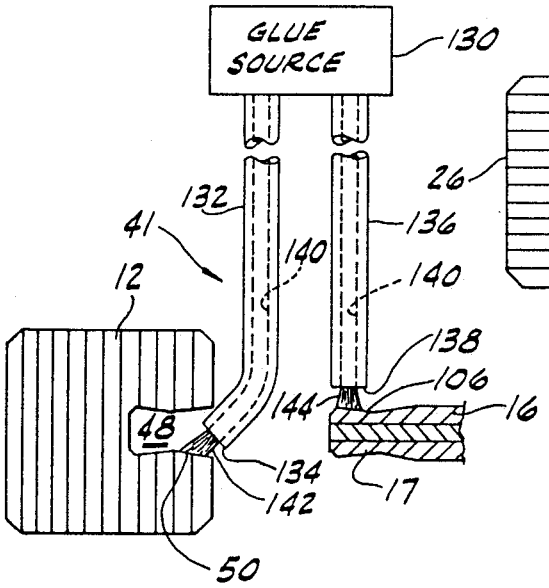
FIG. 13 is a diagrammatic, partly sectional elevation view of glue applicator means for positive metered application of glue to certain surfaces of the web edges and chord grooves of a wood I-beam made according to the present invention.

Reference is now made particularly to FIG. 13 which discloses the glue applicator system generally indicated at 41 in FIGS. 1 and 13. There are two like glue applicator systems 41, one for each web-to-flange joint; and such glue systems are located in the overall assembly system as indicated in FIG. 1. Each glue applicator system 41 has a glue supply means schematically shown at 130; a common glue supply means may be used for both glue applicator systems 41. Glue supply means 130 is of any suitable type obtainable from commercial sources which supply glue equipment to plywood and laminated lumber producers. Each glue applicator system 41 includes a first glue applicator tubing 132 having its lower end 134 disposed above surface 50 of opening 48 in groove 32 of chord flange 12 and in groove 34 of flange 14. Each system 41 also includes a second glue applicator tubing 136 having its lower end 138 disposed above the surface 106 of each of the shaped edges 17 of web 16. Tubing 132 and 136 is made of any suitable commercially available metal or plastic. Such tubing 132, 136 has a bore 140 sized so that glue is applied by positive metered feed from source 130 whereby glue is applied in a continuous glue line 142 on surface 50 of respective grooves 32 and 34 of chord flanges 12 and glue also is applied in a continuous glue line 144 on surface 106 of the shaped edge 17 of web 16. Glue source 130 in conjunction with bores 140 of tubes 132 and 136 provides glue to said surfaces 50 and 106 at a rate correlated to the rate of feed of chord flanges 12 and 14 and web members 16 being joined to form I-beam 15 whereby the glue is applied by positive metered feed as a continuous glue line bead on each of said top surfaces 50 and 106. This arrangement provides a much simplified and more controllable glue application means. It also enables visual inspection and/or light or other instrument sensing to assure glue is applied to said web and flange surfaces 106 and 50 in continuous unbroken ribbons indicated at 142 and 144 in FIG. 13. Further, when the edges 17 of webs 16 are assembled in grooves 32 and 34 of chord flanges 12 and 14 to form joints 13 of I-beam 15 as shown and described, the glue ribbons 142 and 144 are caused to spread around all interfacing surfaces of web edges 17 and openings 48 of chord grooves 32 and 34 to form a good glue-bonded joint 13 which longitudinally extends with integrity along each side of resultant I-beam 15. In the embodiment of FIGS. 15–17, glue or adhesive is similarly applied to surfaces 50 of openings 48*a* in the grooves of flange 12*a* and opposite flange not shown and to surfaces 106 at the shaped edges 17 of web 16. In the embodiment of FIGS. 18–20, glue or adhesive is similarly applied to the surfaces 50*b* in the grooves of flange 12*b* and opposite flange not shown and to surfaces 106*b* at the shaped edges 17*b* of web 16*b*.

Supplementing above discussion of the mechanical interlock between edges 17 of web 16 and the grooves 32 and 34 of flanges 14 and 16, the minimum width of the groove 48 at the necked-down portion 52 is related to the maximum outer edge width 91 of the shaped edge 17 of web member 16 in such a manner that the compression of the outer edges 17 of the web member as it enters openings 48 of the flange grooves does not crush the wood fibers to the extent of creating permanent deformation. As a result, each edge 17 of the web member 16 resumes substantially its original width after passing the necked-down portion of the associated flange groove to create the desired interlocking relationship and form a mechanically interlocked joint which is subsequently adhesively secured by the glue and adhesively held in the mechanically interlocked joint.

In order to realize the optimum advantages of the method, system and structural beam of the invention, certain dimensional relationships are preferable. In the illustrative embodiment which has been described utilizing a ⅜-inch nominal thickness web member 16, the difference between the maximum web edge width 119 of 0.345 inches and the minimum groove width 52 of 0.285 inches is 0.060 inches, or 0.030 inches on each side of the web 16. It has been found that this provides the desired interlock without destructive and irreversible crushing of the wood fibers of web edges 17. This 0.030-inch difference of dimension of each side of the flange groove occurs over the 0.625 depth of the groove, or a ratio of 1 to 20.8 which is a preferred dimensional relationship which may be expressed as about 1 to 21.

Referring to the web member, this 0.030-inch divergence per side of the web member occurs over a distance of 0.25 inches along the inclined plane 54 of the web between the bevel 58 (FIG. 2) and 112 (FIG. 7) and the neck 52 (FIGS. 2 and 7) as seen at 105 in relation to the scarfer tool 92 in FIG. 12. This provides a ratio of width 0.030 inches to length 0.25 inches, or about 1 to 8. The outer inclined side wall 50 in FIG. 2 is longer, or 0.312 inches as shown at 83 in FIG. 7. This provides a ratio of width 0.03 inches to length 0.312 inches, or about 1 to 10. The total length of web edge resisting shear forces as the web edge is forced into the slot is also 0.312 inches as seen at 115 in FIG. 8.

In the most frequently encountered chord and web sizes, i.e., chords varying from about 1½×1½ inches to 1¾×3½ inches, and webs varying from ⅜ to ⅝ inches thick, the use of grooves and mating web edges in the shapes and sizes described and illustrated are satisfactory and advantageous. In that size range it is preferably desirable to limit the maximum dimension of web edge to be compressed to approximately 0.045 inches, with the illustrated dimension of 0.030 inches being a satisfactory and preferred dimension. In that same flange and web size range, the minimum dimension of web edge to be compressed is approximately 0.020 inches, with the illustrated dimension of about 0.030 inches again being preferred. If too large web edge compression is created during assembly there will be a destruction of wood fiber and permanent deformation which is detrimental to or destructive of the interlock. If too small web edge compression is created the interlock will be lessened, and potentially to an extent where the mechanical interlock is unable to maintain the joint in an assembled relationship as intended.

It will be appreciated that the insertion of the web edges 17 into the flange grooves 32 and 34 according to the invention imposes a shear stress on the web edge as the aforesaid compression occurs. According to the illustrated and described preferred embodiment, this shear is borne by the 0.312-inch base of the inclined surface at the distal edge of the web as the compression of 0.030 inches occurs at each side of the web. These dimensions provide a ratio of compression to base of 0.030 to 0.312, or about 1 to 10 which represents a preferred dimensional relationship. According to the invention the shear resisting base should preferably be not less than about 0.200 inches in the range of sizes described. It will be appreciated that this shear resistance parameter may also be expressed as a function of the ratio of compression to base described above as about 10 in the illustrated embodiment. While this represents a preferred ratio, the ratio preferably should be maintained within the range of approximately 10 to 21. This may also be expressed in terms of the ratio of the difference in groove wall distance from the center of the groove to the groove depth, or 0.030 to 0.625 or about 1 to 20–21. This may be expressed as an approximate ratio of about 1 to 20–21.

It will be recognized that while the various foregoing relationships are optimal, the benefits of the invention may still be realized while departing from one or more of such relationships within the scope of the appended claims.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A fabricated wood I-beam comprising a pair of elongated wood chord members and a planar web member interconnecting said chord members by means of interfitting adhesive secured joints between said chord members and opposed edges of said web member, said interfitting joints comprising longitudinal grooves in said chord members receiving adhesive and said opposed edges of said web member, said grooves having cross sections shaped to provide a necked-down groove width at a groove depth intermediate the bottom of the grove and the open mouth of the groove, said opposed edges of said web member having cross sections shaped to have a necked-down lateral thickness extending along the edge thereof, the cross sections of said web members, prior to insertion in said grooves, substantially corresponding to the cross sections of said grooves to provide upon mating a substantially self-relieved interlocking fit therewith.

2. A fabricated wood I-beam according to claim 1 wherein the thickness of said web member is greater than the width of said grooves at the open mouths thereof.

3. A fabricated wood I-beam according to claim 2 wherein said web member is shaped to include at each edge thereof substantially coplanar seating edges disposed on opposite sides of the plane of the web member substantially normal to the plane of the web member, said seating edges being positioned to substantially abut the surfaces of said chord members at the sides of the mouths of said grooves.

4. A fabricated wood I-beam according to claim 3 wherein the plane of the seating edges at one edge of said web member is spaced a predetermined distance from the plane of said seating edges at the other edge of said web member to provide a predetermined spacing between said chord members.

5. The fabricated wood I-beam of claim 1, wherein said opposed edges of said web member are formed to define a single locking member with shaped edges establishing a cross section of said single locking member having a necked-down thickness providing an interfitting joint with said two side walls of each said groove, said grooves each defined by two walls and a bottom wall, said walls extending continuously from an open mouth of the groove downwards to the bottom wall of the groove and directly facing each other from the groove mouth to the groove bottom wall without obstruction from the groove bottom wall.

6. The I-beam of claim 1, wherein the cross sections of said web members are substantially identical to the groove cross sections prior to insertion therein.

7. A fabricated wood I-beam comprising a pair of elongated wood chord members and planar web members interconnecting said chord members by means of interlocking joints between said chord members and opposed edges of said web members, said interlocking joints comprising longitudinal grooves in said chord members receiving said opposed edges of said web members, each of said grooves having an hourglass-shaped cross section providing a necked-down groove width at a groove depth intermediate the bottom of the groove and the open mouth of the groove, each of said opposed edges of said web members having an hourglass-shaped cross section with a necked-down lateral thickness extending along each edge thereof so that said opposed edges of said web members have cross sections shaped to substantially correspond with said cross section of said grooves prior to insertion therein, to provide upon mating a substantially self-relieved interlocking fit therewith.

8. A fabricated wood I-beam according to either of claims 1 or 7 wherein said necked-down groove width and said necked-down lateral thickness of said web member edges are disposed at substantially equal distances from the bottom of said groove and the mouth of said groove.

9. A fabricated wood I-beam comprising a pair of elongated wood chord members and a planar web member interconnecting said chord members by means of interlocking adhesive secured joints between said chord members and opposed edges of said web member, said interlocking joints comprising longitudinal grooves in said chord members receiving said opposed edges of said web member, said grooves having cross sections shaped to provide different groove widths at different groove depths and including a lesser groove width at an intermediate groove depth and a greater groove width at a second groove depth greater than said intermediate groove depth, and a greater groove width at a third groove depth lesser than said intermediate groove depth, said opposed edges of said web member having cross sections shaped to substantially mate with said lesser and greater groove widths to provide a substantially self-relieved interlocking fit therewith.

10. The fabricated wood I-beam of claim 9, wherein said opposed edges of said web member are formed to define a single locking member with shaped edges establishing a cross section of said single locking member having a necked-down thickness providing an interfitting joint with said two side walls of each said groove, said grooves each defined by two walls and a bottom wall, said walls extending continuously from an open mouth of the groove downwards to the bottom wall of the groove and directly facing each other from the groove mouth to the groove bottom wall without obstruction from the groove bottom wall.

11. A fabricated wood Ibeam comprising a planar web member joined to an elongated chord member by a joint formed between an edge of the web member and a groove in one surface of the chord member, wherein the groove comprises a bottom and a pair of side walls defining a groove mouth at said surface of said chord member, said side walls each including a pair of substantially planar surfaces inclined in opposite directions from one another in relation to the plane of the web member, said inclined planar surfaces of each said side wall intersecting in an apex extending substantially parallel to and spaced from the said surface of the chord member, said apexes of the side walls of the groove being substantially parallel to one another and spaced substantially equally from said surface to form the narrowest width dimension of the groove, the edge of said web member having a cross section substantially corresponding to the groove cross section, prior to insertion therein, to mate with said groove to form said joint which is self-relieved.

12. A fabricated wood I-beam according to claim 11, wherein said opposed edges of said web member are formed to define a single locking member with shaped edges establishing a cross section of said single locking member having a necked-down thickness providing an interfitting joint with said two side walls of each said groove, said grooves each defined by two walls and a bottom wall, said walls extending continuously from an open mouth of the groove downwards to the bottom wall of the groove and directly facing each other from the groove mouth to the groove bottom wall without obstruction from the groove bottom wall.

13. The I-beam of claim 11, wherein the cross sections of said web members are substantially identical to the groove cross sections prior to insertion therein.

14. A fabricated wood I-beam comprising a planar web member joined to an elongated chord member by a joint formed between an edge of the web member and a groove in one surface of the chord member, wherein the groove comprises a bottom and a pair of side walls, said side walls each including a pair of substantially planar surfaces inclined to one another to form obtuse included angles defining the shape of the wood in the chord forming the side walls and forming complementary reflex angles defining the groove space bounded by said side walls, said inclined planar surfaces of each said side wall intersecting in an apex extending substantially parallel to and spaced from said surface of the chord member, said apexes of the side walls of the groove being substantially parallel to one another and spaced substantially equally from said surface to form the narrowest width dimension of the groove, the edge of said web member having a cross section substantially corresponding to the groove cross section, prior to insertion therein, to mate with said groove to form said joint with a substantially self-relieved interlocking fit.

15. A fabricated wood beam according to claim 14 wherein the inclined planar surfaces of the side walls formed adjacent the groove bottom in a cross section normal to the longitudinal axis of the chord member defined two sides of a triangle having an altitude related to a base thereof as approximately 1 and 21.

16. A fabricated wood beam according to claim 15 wherein the altitude of the triangle is disposed approximately half the distance between the bottom of said groove and said one surface of said chord member.

17. A fabricated wood beam according to any of claims 11–16 wherein the width of the web member is greater than the width of the groove at said one surface of said chord member.

18. A fabricated wood beam according to claim 17 including adhesive joints bonding no less than five substantially mating and substantially planar surfaces of said chord and said web members.

19. A fabricated wood beam according to claim 14 wherein the edge of said web member is shaped on laterally opposed sides thereof which terminate in a transverse web member edge surface, said shaped edge of said web member including on each side thereof a pair of substantially planar surfaces inclined to one another to form an obtuse inclined angle substantially equal to the obtuse angles in said inclined planes in said side walls of said groove, the plane of one of said inclined planar surfaces of said web member on each side thereof intersecting said transverse web member edge, the planes of said inclined planar surfaces of each side of said web member intersecting in an apex adjacent to and substantially coincident with the corresponding apex of the adjacent side wall of said groove, the plane of said planar surface extending from said apex to said transverse web member edge surface being subtended by a base extending from said apex to said transverse web member edge surface substantially parallel to the plane of said planar web member to define with the plane of said planar surface and the plane of the transverse edge surface of said web member a substantially right triangle having an altitude to base ratio of substantially about 1 to 10.

20. A fabricated wood beam according to claim 19 wherein said altitude has a dimension of substantially about 0.300 inches.

21. A fabricated wood I-beam according to claim 14, wherein said opposed edges of said web member are formed to define a single locking member with shaped edges establishing a cross section of said single locking member having a necked-down thickness providing an interfitting joint with said two side walls of each said groove, said grooves each defined by two walls and a bottom wall, said walls extending continuously from an open mouth of the groove downwards to the bottom wall of the groove and directly facing each other from the groove mouth to the groove bottom wall without obstruction from the groove bottom wall.

22. The I-beam of claim 14, wherein the cross sections of said web members are substantially identical to the groove cross sections prior to insertion therein.

23. A fabricated wood I-beam comprising a pair of elongated wood chord members and a planar web member interconnecting said chord members by means of interfitting adhesive secured joints between said chord members and opposed edges of said web member, said interfitting joints comprising longitudinal grooves in said chord members receiving adhesive and said opposed edges of said web member, said grooves having cross sections shaped to provide a necked-down groove width at a groove depth intermediate the bottom of the groove and the open mouth of the groove, each groove defined by two walls and a bottom wall, said walls extending continuously from the open mouth of the groove downwards to the bottom wall of the groove and directly facing each other from the groove mouth to the groove bottom wall without obstruction from the groove bottom wall, said opposed edges of said web member being formed to define a single locking member with shaped edges establishing a cross section of said single locking member having a necked-down thickness providing a self-relieved interlocking joint with said two side walls of each said groove formed with a necked-down groove width at a groove depth intermediate the bottom of the groove and the open mouth of the groove.

* * * * *